US008397814B2

(12) United States Patent
Rodgers et al.

(10) Patent No.: US 8,397,814 B2
(45) Date of Patent: Mar. 19, 2013

(54) PERFORATING STRING WITH BENDING SHOCK DE-COUPLER

(75) Inventors: John P. Rodgers, Roanoke, TX (US); Timothy S. Glenn, Dracut, MA (US); Marco Serra, Winterthur (CH); Edwin A. Eaton, Grapevine, TX (US); John D. Burleson, Denton, TX (US)

(73) Assignee: Halliburton Energy Serivces, Inc., Houston, TX (US)

( * ) Notice: Subject to any disclaimer, the term of this patent is extended or adjusted under 35 U.S.C. 154(b) by 0 days.

(21) Appl. No.: 13/325,909

(22) Filed: Dec. 14, 2011

(65) Prior Publication Data

US 2012/0152616 A1 Jun. 21, 2012

(30) Foreign Application Priority Data

| | | |
|---|---|---|
| Dec. 17, 2010 | (WO) | PCT/US2010/061104 |
| Apr. 29, 2011 | (WO) | PCT/US2011/034690 |
| Aug. 8, 2011 | (WO) | PCT/US2011/046955 |
| Sep. 2, 2011 | (WO) | PCT/US2011/050401 |

(51) Int. Cl.
*E21B 43/11* (2006.01)
*E21B 29/02* (2006.01)
*E21B 17/02* (2006.01)

(52) U.S. Cl. ..... 166/297; 166/55; 175/4.52

(58) Field of Classification Search ..... 166/297, 166/299, 55, 63, 242.6; 102/301, 313; 175/2, 175/4.52, 4.6; 89/1.151, 1.15
See application file for complete search history.

(56) References Cited

U.S. PATENT DOCUMENTS

| | | | | |
|---|---|---|---|---|
| 2,833,213 A | | 5/1958 | Udry | |
| 2,980,017 A | | 4/1961 | Castel | |
| 3,057,296 A | * | 10/1962 | Silverman | 181/116 |
| 3,128,825 A | * | 4/1964 | Blagg | 166/55 |
| 3,143,321 A | | 8/1964 | McGehee et al. | |
| 3,208,378 A | * | 9/1965 | Boop | 175/4.55 |
| 3,216,751 A | * | 11/1965 | Der Mott | 285/264 |
| 3,394,612 A | | 7/1968 | Bogosoff et al. | |
| 3,414,071 A | | 12/1968 | Alberts | |

(Continued)

FOREIGN PATENT DOCUMENTS

| | | |
|---|---|---|
| EP | 2065557 A1 | 6/2009 |
| GB | 2406870 A | 4/2005 |

(Continued)

OTHER PUBLICATIONS

Search Report issued Feb. 9, 2012 for International Application No. PCT/US11/50401, 5 pages.

(Continued)

*Primary Examiner* — Kenneth L Thompson
(74) *Attorney, Agent, or Firm* — Smith IP Services, P.C.

(57) ABSTRACT

A bending shock de-coupler for use with a perforating string can include perforating string connectors at opposite ends of the de-coupler. A bending compliance of the de-coupler may substantially increase between the connectors. A well system can include a perforating string including at least one perforating gun and multiple bending shock de-couplers, each of the de-couplers having a bending compliance, and at least two of the bending compliances being different from each other. A perforating string can include a bending shock de-coupler interconnected longitudinally between two components of the perforating string. A bending compliance of the bending shock de-coupler may substantially decrease in response to angular displacement of one of the components a predetermined amount relative to the other component.

24 Claims, 6 Drawing Sheets

U.S. PATENT DOCUMENTS

| | | | | |
|---|---|---|---|---|
| 3,653,468 | A | 4/1972 | Marshall | |
| 3,687,074 | A * | 8/1972 | Andrews et al. | 116/137 R |
| 3,779,591 | A | 12/1973 | Rands | |
| 3,923,105 | A * | 12/1975 | Lands, Jr. | 175/4.55 |
| 3,923,106 | A * | 12/1975 | Bosse-Platiere | 175/4.55 |
| 3,923,107 | A * | 12/1975 | Dillard | 175/4.55 |
| 3,971,926 | A | 7/1976 | Gau et al. | |
| 4,269,063 | A | 5/1981 | Escaron et al. | |
| 4,319,526 | A | 3/1982 | DerMott | |
| 4,346,795 | A | 8/1982 | Herbert | |
| 4,409,824 | A | 10/1983 | Salama et al. | |
| 4,410,051 | A | 10/1983 | Daniel et al. | |
| 4,419,933 | A | 12/1983 | Kirby et al. | |
| 4,480,690 | A | 11/1984 | Vann | |
| 4,575,026 | A | 3/1986 | Brittain et al. | |
| 4,598,776 | A | 7/1986 | Stout | |
| 4,612,992 | A | 9/1986 | Vann et al. | |
| 4,619,333 | A * | 10/1986 | George | 175/4.52 |
| 4,637,478 | A | 1/1987 | George | |
| 4,679,669 | A | 7/1987 | Kalb et al. | |
| 4,693,317 | A * | 9/1987 | Edwards et al. | 166/378 |
| 4,764,231 | A | 8/1988 | Slawinski et al. | |
| 4,817,710 | A | 4/1989 | Edwards et al. | |
| 4,830,120 | A | 5/1989 | Stout | |
| 4,842,059 | A | 6/1989 | Tomek | |
| 4,901,802 | A * | 2/1990 | George et al. | 175/4.52 |
| 4,913,053 | A | 4/1990 | McPhee | |
| 4,971,153 | A | 11/1990 | Rowe et al. | |
| 5,027,708 | A | 7/1991 | Gonzalez et al. | |
| 5,044,437 | A | 9/1991 | Wittrisch | |
| 5,078,210 | A | 1/1992 | George | |
| 5,088,557 | A | 2/1992 | Ricles et al. | |
| 5,092,167 | A | 3/1992 | Finley et al. | |
| 5,103,912 | A | 4/1992 | Flint | |
| 5,107,927 | A | 4/1992 | Whiteley et al. | |
| 5,109,355 | A | 4/1992 | Yuno | |
| 5,117,911 | A | 6/1992 | Navarette et al. | |
| 5,131,470 | A * | 7/1992 | Miszewski et al. | 166/297 |
| 5,133,419 | A | 7/1992 | Barrington | |
| 5,161,616 | A | 11/1992 | Colla | |
| 5,188,191 | A | 2/1993 | Tomek | |
| 5,216,197 | A | 6/1993 | Huber et al. | |
| 5,287,924 | A | 2/1994 | Burleson et al. | |
| 5,343,963 | A | 9/1994 | Bouldin et al. | |
| 5,351,791 | A | 10/1994 | Rosenzweig | |
| 5,366,013 | A | 11/1994 | Edwards et al. | |
| 5,421,780 | A | 6/1995 | Vukovic | |
| 5,529,127 | A | 6/1996 | Burleson et al. | |
| 5,547,148 | A | 8/1996 | Del Monte et al. | |
| 5,598,894 | A | 2/1997 | Burleson et al. | |
| 5,603,379 | A | 2/1997 | Henke et al. | |
| 5,662,166 | A | 9/1997 | Shammai | |
| 5,774,420 | A | 6/1998 | Heysse et al. | |
| 5,813,480 | A | 9/1998 | Zaleski, Jr. et al. | |
| 5,823,266 | A | 10/1998 | Burleson et al. | |
| 5,826,654 | A | 10/1998 | Adnan et al. | |
| 5,957,209 | A | 9/1999 | Burleson et al. | |
| 5,964,294 | A | 10/1999 | Edwards et al. | |
| 5,992,523 | A | 11/1999 | Burleson et al. | |
| 6,012,015 | A | 1/2000 | Tubel | |
| 6,021,377 | A | 2/2000 | Dubinsky et al. | |
| 6,068,394 | A | 5/2000 | Dublin, Jr. | |
| 6,078,867 | A | 6/2000 | Plumb et al. | |
| 6,098,716 | A | 8/2000 | Hromas et al. | |
| 6,135,252 | A | 10/2000 | Knotts | |
| 6,173,779 | B1 * | 1/2001 | Smith | 166/297 |
| 6,216,533 | B1 | 4/2001 | Woloson et al. | |
| 6,230,101 | B1 | 5/2001 | Wallis | |
| 6,283,214 | B1 | 9/2001 | Guinot et al. | |
| 6,308,809 | B1 | 10/2001 | Reid et al. | |
| 6,371,541 | B1 | 4/2002 | Pedersen | |
| 6,394,241 | B1 | 5/2002 | Desjardins et al. | |
| 6,397,752 | B1 | 6/2002 | Yang et al. | |
| 6,408,953 | B1 | 6/2002 | Goldman et al. | |
| 6,412,415 | B1 | 7/2002 | Kothari et al. | |
| 6,412,614 | B1 | 7/2002 | Lagrange et al. | |
| 6,450,022 | B1 | 9/2002 | Brewer | |
| 6,454,012 | B1 | 9/2002 | Reid | |
| 6,457,570 | B2 | 10/2002 | Reid et al. | |
| 6,484,801 | B2 | 11/2002 | Brewer et al. | |
| 6,543,538 | B2 | 4/2003 | Tolman et al. | |
| 6,550,322 | B2 | 4/2003 | Sweetland et al. | |
| 6,595,290 | B2 | 7/2003 | George et al. | |
| 6,672,405 | B2 | 1/2004 | Tolman et al. | |
| 6,674,432 | B2 | 1/2004 | Kennon et al. | |
| 6,679,323 | B2 | 1/2004 | Vargervik et al. | |
| 6,679,327 | B2 | 1/2004 | Sloan et al. | |
| 6,684,949 | B1 | 2/2004 | Gabler et al. | |
| 6,684,954 | B2 * | 2/2004 | George | 166/297 |
| 6,708,761 | B2 | 3/2004 | George et al. | |
| 6,810,370 | B1 | 10/2004 | Watts, III | |
| 6,826,483 | B1 | 11/2004 | Anderson | |
| 6,832,159 | B2 | 12/2004 | Smits et al. | |
| 6,842,725 | B1 | 1/2005 | Sarda | |
| 6,868,920 | B2 | 3/2005 | Hoteit et al. | |
| 7,000,699 | B2 | 2/2006 | Yang et al. | |
| 7,006,959 | B1 | 2/2006 | Huh et al. | |
| 7,044,219 | B2 | 5/2006 | Mason et al. | |
| 7,114,564 | B2 | 10/2006 | Parrott et al. | |
| 7,121,340 | B2 | 10/2006 | Grove et al. | |
| 7,139,689 | B2 | 11/2006 | Huang | |
| 7,147,088 | B2 | 12/2006 | Reid et al. | |
| 7,165,612 | B2 | 1/2007 | McLaughlin | |
| 7,178,608 | B2 | 2/2007 | Mayes et al. | |
| 7,195,066 | B2 | 3/2007 | Sukup et al. | |
| 7,234,517 | B2 | 6/2007 | Streich et al. | |
| 7,246,659 | B2 * | 7/2007 | Fripp et al. | 166/55.1 |
| 7,260,508 | B2 | 8/2007 | Lim et al. | |
| 7,278,480 | B2 | 10/2007 | Longfield et al. | |
| 7,387,160 | B2 | 6/2008 | O'Shaughnessy et al. | |
| 7,387,162 | B2 | 6/2008 | Mooney, Jr. et al. | |
| 7,503,403 | B2 | 3/2009 | Jogi et al. | |
| 7,509,245 | B2 | 3/2009 | Siebrits et al. | |
| 7,533,722 | B2 | 5/2009 | George et al. | |
| 7,600,568 | B2 * | 10/2009 | Ross et al. | 166/297 |
| 7,603,264 | B2 | 10/2009 | Zamora et al. | |
| 7,640,986 | B2 | 1/2010 | Behrmann et al. | |
| 7,721,650 | B2 | 5/2010 | Barton et al. | |
| 7,721,820 | B2 | 5/2010 | Hill et al. | |
| 7,762,331 | B2 | 7/2010 | Goodman et al. | |
| 7,770,662 | B2 | 8/2010 | Harvey et al. | |
| 8,126,646 | B2 | 2/2012 | Grove et al. | |
| 8,136,608 | B2 | 3/2012 | Goodman | |
| 2002/0121134 | A1 | 9/2002 | Sweetland et al. | |
| 2003/0062169 | A1 | 4/2003 | Marshall | |
| 2003/0089497 | A1 | 5/2003 | George et al. | |
| 2003/0150646 | A1 | 8/2003 | Brooks et al. | |
| 2004/0045351 | A1 | 3/2004 | Skinner | |
| 2004/0104029 | A1 | 6/2004 | Martin | |
| 2004/0140090 | A1 | 7/2004 | Mason et al. | |
| 2006/0070734 | A1 | 4/2006 | Zillinger et al. | |
| 2006/0118297 | A1 | 6/2006 | Finci et al. | |
| 2006/0243453 | A1 | 11/2006 | McKee | |
| 2007/0101808 | A1 | 5/2007 | Irani et al. | |
| 2007/0193740 | A1 | 8/2007 | Quint | |
| 2007/0214990 | A1 | 9/2007 | Barkley et al. | |
| 2008/0041597 | A1 | 2/2008 | Fisher et al. | |
| 2008/0149338 | A1 | 6/2008 | Goodman et al. | |
| 2008/0202325 | A1 | 8/2008 | Bertoja et al. | |
| 2008/0216554 | A1 | 9/2008 | McKee | |
| 2008/0245255 | A1 | 10/2008 | Barton et al. | |
| 2008/0262810 | A1 | 10/2008 | Moran et al. | |
| 2008/0314582 | A1 | 12/2008 | Belani et al. | |
| 2009/0013775 | A1 | 1/2009 | Bogath et al. | |
| 2009/0071645 | A1 | 3/2009 | Kenison et al. | |
| 2009/0084535 | A1 | 4/2009 | Bertoja et al. | |
| 2009/0151589 | A1 | 6/2009 | Henderson et al. | |
| 2009/0159284 | A1 | 6/2009 | Goodman | |
| 2009/0223400 | A1 | 9/2009 | Hill et al. | |
| 2009/0241658 | A1 | 10/2009 | Irani et al. | |
| 2009/0272529 | A1 | 11/2009 | Crawford | |
| 2010/0000789 | A1 | 1/2010 | Barton et al. | |
| 2010/0037793 | A1 | 2/2010 | Lee et al. | |
| 2010/0085210 | A1 | 4/2010 | Bonavides et al. | |
| 2010/0132939 | A1 | 6/2010 | Rodgers | |
| 2010/0133004 | A1 | 6/2010 | Burleson et al. | |
| 2010/0147519 | A1 | 6/2010 | Goodman | |

| | | | |
|---|---|---|---|
| 2010/0230105 | A1 | 9/2010 | Vaynshteyn |
| 2012/0085539 | A1 | 4/2012 | Tonnessen et al. |
| 2012/0152519 | A1 | 6/2012 | Rodgers et al. |
| 2012/0152542 | A1 | 6/2012 | Le |
| 2012/0152614 | A1 | 6/2012 | Rodgers et al. |
| 2012/0152615 | A1 | 6/2012 | Rodgers et al. |
| 2012/0152616 | A1 | 6/2012 | Rodgers et al. |
| 2012/0158388 | A1 | 6/2012 | Rodgers et al. |

FOREIGN PATENT DOCUMENTS

| | | | |
|---|---|---|---|
| WO | 2004076813 | A1 | 9/2004 |
| WO | 2004099564 | A2 | 11/2004 |
| WO | 2007056121 | A1 | 5/2007 |

OTHER PUBLICATIONS

Written Opinion issued Feb. 9, 2012 for International Application No. PCT/US11/50401, 3 pages.
Kenji Furui; "A Comprehensive Skin Factor Model for Well Completions Based on Finite Element Simulations", informational paper, dated May 2004, 182 pages.
Patent Application and Drawings, filed Dec. 17, 2010, serial No. PCT/US10/61104, 38 pages.
Scott A. Ager; "IES Fast Speed Gauges", informational presentation, dated Mar. 2, 2009, 38 pages.
IES; "Battery Packing for High Shock", article AN102, 4 pages.
IES; "Accelerometer Wire Termination", article AN106, 4 pages.
John F. Schatz; "PulsFrac Validation: Owen/HTH Surface Block Test", product information, dated 2004, 4 pages.
John F. Schatz; "Casing Differential in PulsFrac Calculations", product information, dated 2004, 2 pages.
John F. Schatz; "The Role of Compressibility in PulsFrac Software", informational paper, dated Aug. 22, 2007, 2 pages.
Essca Group; "Erin Dynamic Flow Analysis Platform", online article, dated 2009, 1 page.
Halliburton; "Fast Gauge Recorder", article 5-110, 2 pages.
Halliburton; "Simulation Software for EquiFlow ICE Completions", H07010, dated Sep. 2009, 2 pages.
Halliburton; "AutoLatch Release Gun Connector", Special Applications 6-7, 1 page.
Halliburton; "Body Lock Ring", Mechanical Downhole: Technology Transfer, dated Oct. 10, 2001, 4 pages.
Starboard Innovations, LLC; "Downhole Mechanical Shock Absorber", patent and prior art search results, Preliminary Report, dated Jul. 8, 2010, 22 pages.
Carlos Baumann, Harvey Williams, and Schlumberger; "Perforating Wellbore Dynamics and Gunshock in Deepwater TCP Operations", Product informational presentation, IPS-10-018, 28 pages.
Schlumberger; "SXVA Explosively Initiated Vertical Shock Absorber", product paper 06-WT-066, dated 2007, 1 page.
International Search Report with Written Opinion issued Dec. 27, 2011 for PCT Patent Application No. PCT/US11/046955, 8 pages.
International Search Report with Written Opinion issued Jul. 28, 2011 for International Application No. PCT/US10/61104, 8 pages.
International Search Report with Written Opinion issued Nov. 22, 2011 for International Application No. PCT/US11/029412, 9 pages.
International Search Report with Written Opinion issued Jul. 28, 2011 for International Application No. PCT/US10/061107, 9 pages.
International Search Report with Written Opinion issued Oct. 27, 2011 for International Application No. PCT/US11/034690, 9 pages.
Office Action issued Apr. 21, 2011 for U.S. Appl. No. 13/008,075, 9 pages.
Office Action issued May 4, 2011 for U.S. Appl. No. 11/957,541, 9 pages.
Patent Application, filed Dec. 17, 2010, serial No. PCT/US10/61104, 29 pages.
Drawings, filed Dec. 17, 2010, serial No. PCT/US10/61104, 10 figures, 9 pages.
Halliburton; "Simulation Software for EquiFlow ICD Completions", H07010, dated Sep. 2009, 2 pages.
Office Action issued Sep. 8, 2009, for U.S. Appl. No. 11/957,541, 10 pages.
Office Action issued Feb. 2, 2010, for U.S. Appl. No. 11/957,541, 8 pages.
Office Action issued Jul. 15, 2010, for U.S. Appl. No. 11/957,541, 6 pages.
Office Action issued Nov. 22, 2010, for U.S. Appl. No. 11/957,541, 6 pages.
Office Action issued May 4, 2011, for U.S. Appl. No. 11/957,541, 9 pages.
Office Action issued Apr. 21, 2011, for U.S. Appl. No. 13/008,075, 9 pages.
J.A. Regalbuto et al; "Computer Codes for Oilwell-Perforator Design", SPE 30182, dated Sep. 1997, 8 pages.
Joseph Ansah et al; "Advances in Well Completion Design: A New 3D Finite-Element Wellbore Inflow Model for Optimizing Performance of Perforated Completions", SPE 73760, Feb. 20-21, 2002, 11 pages.
D.A. Cuthill et al; "A New Technique for Rapid Estimation of Fracture Closure Stress When Using Propellants", SPE 78171, dated Oct. 20-23, 2002, 6 pages.
J.F. Schatz et al; "High-Speed Pressure and Accelerometer Measurements Characterize Dynamic Behavior During Perforating Events in Deepwater Gulf of Mexico", SPE 90042, dated Sep. 26-29, 2004, 15 pages.
Liang-Biao Ouyang et al; "Case Studies for Improving Completion Design Through Comprehensive Well-Performance Modeling", SPE 104078, dated Dec. 5-7, 2006, 11 pages.
Liang-Biao Ouyang et al; "Uncertainty Assessment on Well-Performance Prediction for an Oil Producer Equipped With Selected Completions", SPE 106966, dated Mar. 31-Apr. 3, 2007, 9 pages.
B. Grove et al; "New Effective Stress Law for Predicting Perforation Depth at Downhole Conditions", SPE 111778, dated Feb. 13-15, 2008, 10 pages.
Office Action issued Oct. 1, 2012 for U.S. Appl. No. 13/325,726, 20 pages.
International Search Report with Written Opinion issued Nov. 30, 2011 for PCT/US11/036686, 10 pages.
Specification and drawing for U.S. Appl. No. 13/585,846, filed Aug. 25, 2012, 45 pages.
International Search Report with Written Opinion issued Feb. 17, 2012 for PCT Patent Application No. PCT/US11/050392, 9 pages.
International Search Report with Written Opinion issued Feb. 20, 2012 for PCT Patent Application No. PCT/US11/049882, 9 pages.
Office Action issued Feb. 24, 2012 for U.S. Appl. No. 13/304,075, 15 pages.
Office Action issued Apr. 10, 2012 for U.S. Appl. No. 13/325,726, 26 pages.
Office Action issued Jun. 7, 2012 for U.S. Appl. No. 13/430,550, 21 pages.
Office Action issued Jun. 29, 2012 for U.S. Appl. No. 13/325,866, 30 pages.
Office Action issued Jul. 12, 2012 for U.S. Appl. No. 13/413,588, 42 pages.
Office Action issued Jul. 26, 2012 for U.S. Appl. No. 13/325,726, 52 pages.
Office Action issued Aug. 2, 2012 for U.S. Appl. No. 13/210,303, 35 pages.
Office Action issued Sep. 6, 2012 for U.S. Appl. No. 13/495,035, 28 pages.
J.F. Schatz et al; "High-Speed Downhole Memory Recorder and Software Used to Design and Confirm Perforating/Propellant Behavior and Formation Fracturing", SPE 56434, dated Oct. 3-6, 1999, 9 pages.
IES, Scott A. Ager; "IES Housing and High Shock Considerations", informational presentation, 18 pages.
IES, Scott A. Ager; Analog Recorder Test Example, informational letter, dated Sep. 1, 2010, 1 page.
IES, Scott A. Ager; "Series 300 Gauge", product information, dated Sep. 1, 2010, 1 page.
IES, Scott A. Ager; "IES Introduction", Company introduction presentation, 23 pages.
Petroleum Experts; "IPM: Engineering Software Development", product brochure, dated 2008, 27 pages.
International Search Report with Written Opinion issued Oct. 27, 2011 for PCT Patent Application No. PCT/US11/034690, 9 pages.

Kappa Engineering; "Petroleum Exploration and Product Software, Training and Consulting", product informational paper on v4.12B, dated Jan. 2010, 48 pages.
Qiankun Jin, Zheng Shigui, Gary Ding, Yianjun, Cui Binggui, Beijing Engeneering Software Technology Co. Ltd.; "3D Numerical Simulations of Penetration of Oil-Well Perforator into Concrete Targets", Paper for the 7th International LS-DYNA Users Conference, 6 pages.
Mario Dobrilovic, Zvonimir Ester, Trpimir Kujundzic; "Measurments of Shock Wave Force in Shock Tube with Indirect Methods", Original scientific paper vol. 17, str. 55-60, dated 2005, 6 pages.
IES, Scott A. Ager; "Model 64 and 74 Buildup", product presentation, dated Oct. 17, 2006,57 pages.
Specification and Drawings for U.S. Appl. No. 13/493,327, filed Jun. 11, 2012, 30 pages.
"2010 International Perforating Symposium", Agenda, dated May 6-7, 2010, 2 pages.
Specification and drawing for U.S. Appl. No. 13/413,588, filed Mar. 6, 2012, 30 pages.
International Search Report with Written Opinion issued Jul. 28, 2011 for International Application No. PCT/US10/61102, 8 pages.
Specification and drawing for U.S. Appl. No. 13/377,148, filed Dec. 8, 2011, 47 pages.
Office Action issued Jun. 13, 2012 for U.S. Appl. No. 13/377,148, 38 pages.
Specification and drawing for U.S. Appl. No. 13/078,423, filed Apr. 1, 2011, 42 pages.
Specification and drawing for US Patent Application No. PCT/US11/49882, filed Aug. 31, 2011, 26 pages.
Offshore Technology Conference; "Predicting Pressure Behavior and Dynamic Shock Loads on Completion Hardware During Perforating", OTC 21059, dated May 3-6, 2010, 11 pages.
IES; "Series 200: High Shock, High Speed Pressure and Acceleration Gauge", product brochure, 2 pages.
Terje Rudshaug, et al.; "A toolbox for improved Reservoir Management", NETool, Force AWTC Seminar, Apr. 21-22, 2004, 29 pages.
Halliburton; "ShockPro Schockload Evaluation Service", Perforating Solutions pp. 5-125 to 5-126, dated 2007, 2 pages.
Halliburton; "ShockPro Schockload Evaluation Service", H03888, dated Jul. 2007, 2 pages.
Strain Gages; "Positioning Strain Gages to Monitor Bending, Axial, Shear, and Torsional Loads", p. E-5 to E-6, dated 2012, 2 pages.
B. Grove, et al.; "Explosion-Induced Damage to Oilwell Perforating Gun Carriers", Structures Under Shock and Impact IX, vol. 87, ISSN 1743-3509, SU060171, dated 2006, 12 pages.
WEM; "Well Evaluation Model", product brochure, 2 pages.
Endevco; "Problems in High-Shock Measurement", MEGGITT brochure TP308, dated Jul. 2007, 9 pages.
A. Blakeborough et al.; "Novel Load Cell for Measuring Axial Forca, Shear Force, and Bending Movement in large-scale Structural Experiments", Informational paper, dated Mar. 23-Aug. 30, 2001, 8 pages.
Weibing Li et al.; "The Effect of Annular Multi-Point Initiation on the Formation and Penetration of an Explosively Formed Penetrator", Article in the International Journal of Impact Engineering, dated Aug. 27, 2009, 11 pages.
Sergio Murilo et al.; "Optimization and Automation of Modeling of Flow Perforated Oil Wells", Presentation for the Product Development Conference, dated 2004, 31 pages.
Frederic Bruyere et al.; "New Practices to Enhance Perforating Results", Oilfield Review, dated Autumn 2006, 18 pages.
John F. Schatz; "Perf Breakdown, Fracturing, and Cleanup in PulsFrac", informational brochure, dated May 2, 2007, 6 pages.
M. A. Proett et al.; "Productivity Optimization of Oil Wells Using a New 3D Finite-Element Wellbore Inflow Model and Artificial Neutral Network", conference paper, dated 2004, 17 pages.
John F. Schatz; "PulsFrac Summary Technical Description", informational brochure, dated 2003, 8 pages.
IES, Scott A. Ager; "IES Recorder Buildup", Company presentation, 59 pages.
IES, Scott A. Ager; "IES Sensor Discussion", 38 pages.
IES; "Series 300: High Shock, High Speed Pressure Gauge", product brochure, dated Feb. 1, 2012, 2 pages.
Australian Examination Report issued Sep. 21, 2012 for AU Patent Application No. 2010365400, 3 pages.
Office Action issued Oct. 23, 2012 for U.S. Appl. No. 13/325,866, 35 pages.
Office Action issued Dec. 12, 2012 for U.S. Appl. No. 13/493,327, 75 pages.
Office Action issued Dec. 14, 2012 for U.S. Appl. No. 13/495,035, 19 pages.
Office Action issued Dec. 18, 2012 for U.S. Appl. No. 13/533,600, 48 pages.

* cited by examiner

PERFORATING STRING WITH BENDING SHOCK DE-COUPLER

CROSS-REFERENCE TO RELATED APPLICATIONS

This application claims the benefit under 35 USC §119 of the filing date of International Application Serial No. PCT/US11/50401 filed 2 Sep. 2011, International Application Serial No. PCT/US11/46955 filed 8 Aug. 2011, International Patent Application Serial No. PCT/US11/34690 filed 29 Apr. 2011, and International Patent Application Serial No. PCT/US10/61104 filed 17 Dec. 2010. The entire disclosures of these prior applications are incorporated herein by this reference.

BACKGROUND

The present disclosure relates generally to equipment utilized and operations performed in conjunction with a subterranean well and, in an embodiment described herein, more particularly provides for mitigating shock produced by well perforating.

Shock absorbers have been used in the past to absorb shock produced by detonation of perforating guns in wells. Unfortunately, prior shock absorbers have enjoyed only very limited success. In part, the present inventors have postulated that this is due at least in part to the prior shock absorbers being incapable of reacting sufficiently quickly to allow some angular displacement of one perforating string component relative to another during a shock event, thereby reflecting rather than coupling the shock.

SUMMARY

In carrying out the principles of this disclosure, a shock de-coupler is provided which brings improvements to the art of mitigating shock produced by perforating strings. One example is described below in which a bending shock de-coupler is, at least initially, relatively compliant. Another example is described below in which the shock de-coupler permits relatively unrestricted bending of the perforating string due to a perforating event, but bending compliance can be decreased substantially in response to the bending exceeding a limit.

In one aspect, a bending shock de-coupler for use with a perforating string is provided to the art by this disclosure. In one example, the de-coupler can include perforating string connectors at opposite ends of the de-coupler. A bending compliance of the de-coupler substantially increases between the connectors.

In another aspect, a well system is described below. In one example, the well system can include a perforating string including at least one perforating gun and multiple bending shock de-couplers, each of the de-couplers having a bending compliance, and at least two of the bending compliances being different from each other.

In yet another aspect, the disclosure below describes a perforating string. In one example, the perforating string can include a bending shock de-coupler interconnected longitudinally between two components of the perforating string. A bending compliance of the bending shock de-coupler substantially decreases in response to angular displacement of one of the components a predetermined amount relative to the other component.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
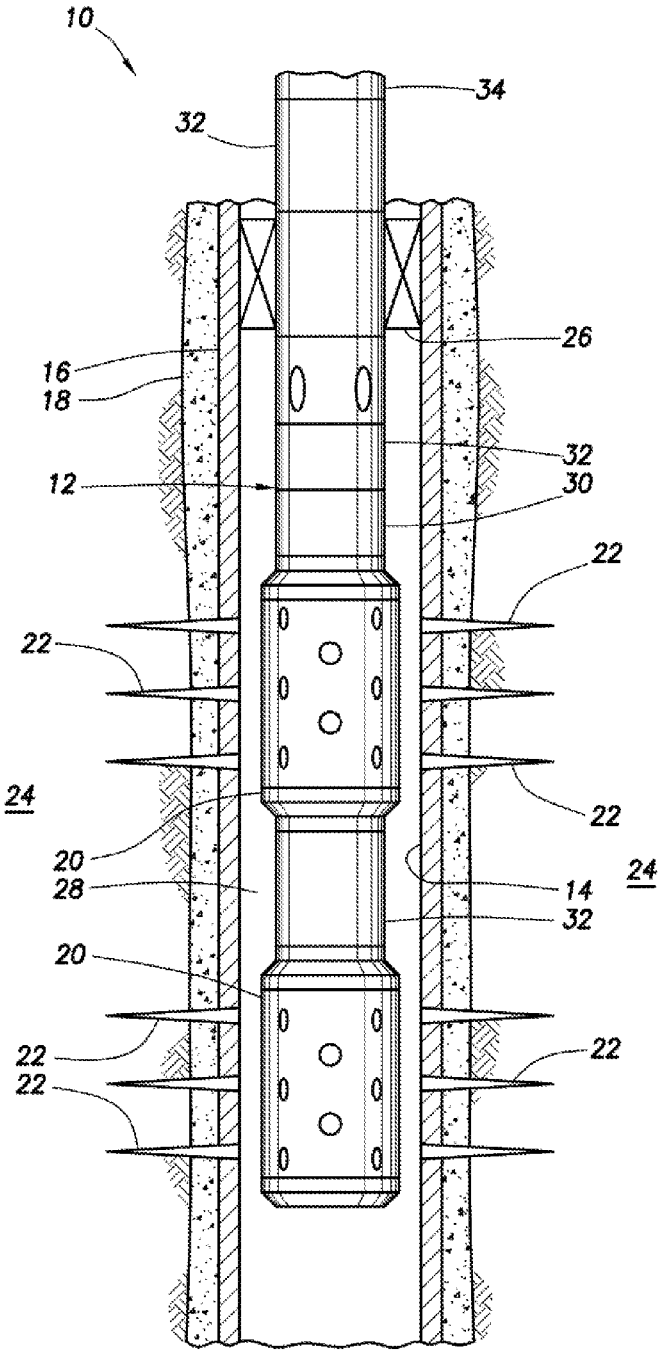
FIG. 1 is a representative partially cross-sectional view of a well system and associated method which can embody principles of this disclosure.

Representatively illustrated in FIG. 1 is a well system 10 and associated method which can embody principles of this disclosure. In the system 10, a perforating string 12 is positioned in a wellbore 14 lined with casing 16 and cement 18. Perforating guns 20 in the perforating string 12 are positioned opposite predetermined locations for forming perforations 22 through the casing 16 and cement 18, and outward into an earth formation 24 surrounding the wellbore 14.

The perforating string 12 is sealed and secured in the casing 16 by a packer 26. The packer 26 seals off an annulus 28 formed radially between the tubular string 12 and the wellbore 14.

A firing head 30 is used to initiate firing or detonation of the perforating guns 20 (e.g., in response to a mechanical, hydraulic, electrical, optical or other type of signal, passage of time, etc.), when it is desired to form the perforations 22. Although the firing head 30 is depicted in FIG. 1 as being connected above the perforating guns 20, one or more firing heads may be interconnected in the perforating string 12 at any location, with the location(s) preferably being connected to the perforating guns by a detonation train.

In the example of FIG. 1, bending shock de-couplers 32 are interconnected in the perforating string 12 at various locations. In other examples, the shock de-couplers 32 could be used in other locations along a perforating string, other shock de-coupler quantities (including one) may be used, etc.

One of the shock de-couplers 32 is interconnected between two of the perforating guns 20. In this position, a shock de-coupler can mitigate the transmission of bending shock between perforating guns, and thereby prevent the accumulation of shock effects along a perforating string.

Another one of the shock de-couplers 32 is interconnected between the packer 26 and the perforating guns 20. In this position, a shock de-coupler can mitigate the transmission of bending shock from perforating guns to a packer, which could otherwise unset or damage the packer, cause damage to the tubular string between the packer and the perforating guns, etc. This shock de-coupler 32 is depicted in FIG. 1 as being positioned between the firing head 30 and the packer 26, but in other examples it may be positioned between the firing head and the perforating guns 20, etc.

Yet another of the shock de-couplers 32 is interconnected above the packer 26. In this position, a shock de-coupler can mitigate the transmission of bending shock from the perforating string 12 to a tubular string 34 (such as a production or injection tubing string, a work string, etc.) above the packer 26.

At this point, it should be noted that the well system 10 of FIG. 1 is merely one example of an unlimited variety of different well systems which can embody principles of this disclosure. Thus, the scope of this disclosure is not limited at all to the details of the well system 10, its associated methods, the perforating string 12, etc. described herein or depicted in the drawings.

For example, it is not necessary for the wellbore 14 to be vertical, for there to be two of the perforating guns 20, or for the firing head 30 to be positioned between the perforating guns and the packer 26, etc. Instead, the well system 10 configuration of FIG. 1 is intended merely to illustrate how the principles of this disclosure may be applied to an example perforating string 12, in order to mitigate the effects of a perforating event. These principles can be applied to many other examples of well systems and perforating strings, while remaining within the scope of this disclosure.

The bending shock de-couplers 32 are referred to as "de-couplers," since they function to prevent, or at least mitigate, coupling of bending shock between components connected to opposite ends of the de-couplers. In the example of FIG. 1, the coupling of bending shock is mitigated between perforating string 12 components, including the perforating guns 20, the firing head 30, the packer 26 and the tubular string 34. However, in other examples, coupling of bending shock between other components and other combinations of components may be mitigated, while remaining within the scope of this disclosure.

To prevent coupling of bending shock between components, it is desirable to allow the components to bend (angularly deflect about the x and/or y axes, if z is the longitudinal axis) relative to one another, while remaining longitudinally connected. In this manner, bending shock is reflected, rather than transmitted through the shock de-couplers 32.

In examples of the shock de-couplers 32 described more fully below, the shock de-couplers can mitigate the coupling of bending shock between components. By permitting relatively high compliance bending of the components relative to one another, the shock de-couplers 32 mitigate the coupling of bending shock between the components. The bending compliance can be substantially decreased, however, when a predetermined angular displacement has been reached.

Figure 2:
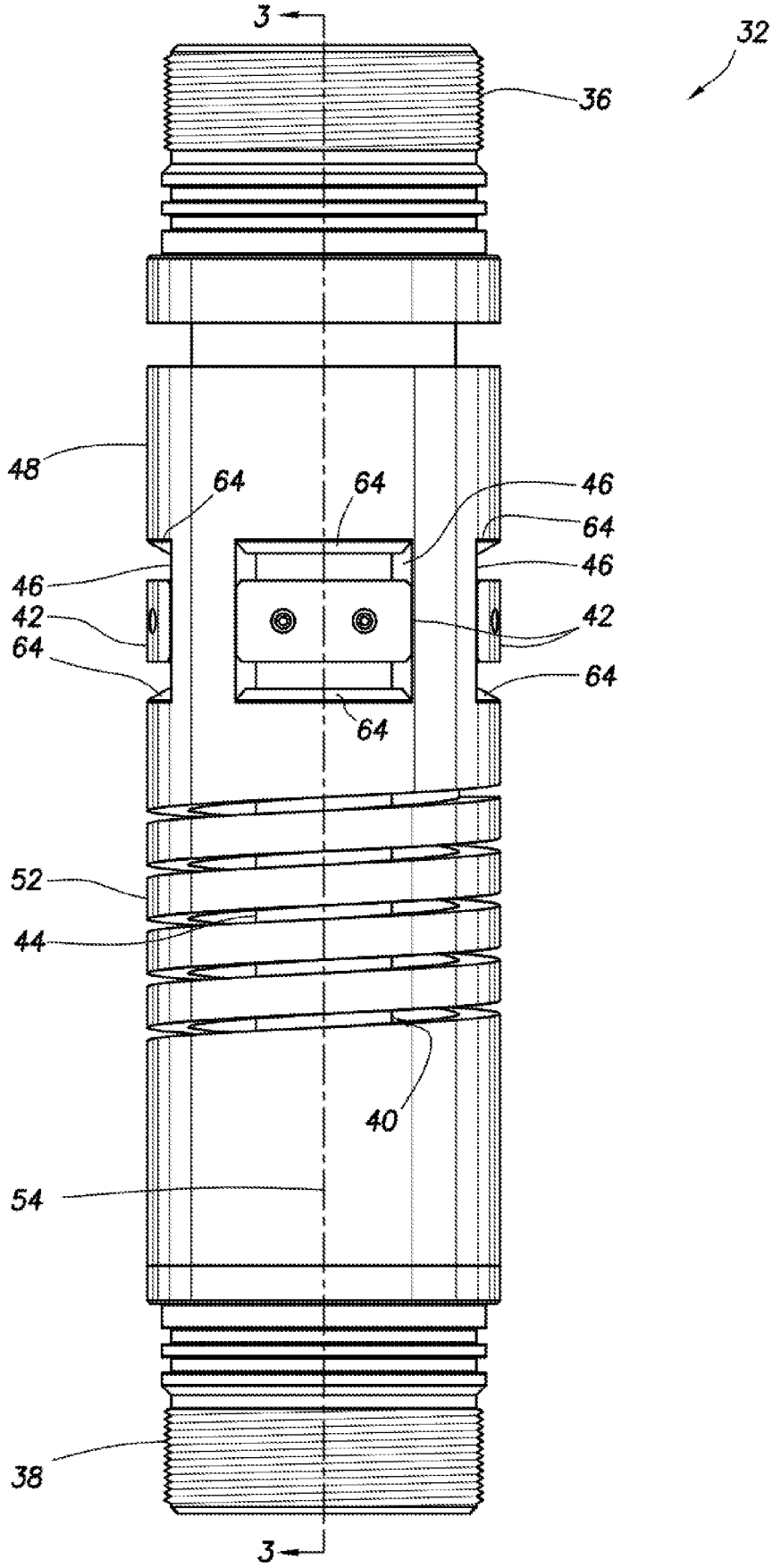
FIG. 2 is a representative side view of a bending shock de-coupler which may be used in the system and method of FIG. 1, and which can embody principles of this disclosure.

Referring additionally now to FIG. 2, a side view of one example of the bending shock de-couplers 32 is representatively illustrated. The shock de-coupler 32 depicted in FIG. 2 may be used in the well system 10, or it may be used in other well systems, in keeping with the scope of this disclosure.

In this example, perforating string connectors 36, 38 are provided at opposite ends of the shock de-coupler 32, thereby allowing the shock de-coupler to be conveniently interconnected between various components of the perforating string 12. The perforating string connectors 36, 38 can include threads, elastomer or non-elastomer seals, metal-to-metal seals, and/or any other feature suitable for use in connecting components of a perforating string.

An elongated mandrel 40 extends upwardly (as viewed in FIG. 2) from the connector 38. Multiple elongated generally rectangular projections 42 are attached circumferentially spaced apart on an upper portion of the mandrel 40.

The projections 42 are complementarily received in longitudinally elongated slots 46 formed through a sidewall of a generally tubular housing 48 extending downwardly (as viewed in FIG. 2) from the connector 36. When assembled, the mandrel 40 is reciprocably received in the housing 48, as may best be seen in the representative cross-sectional view of FIG. 3. The projections 42 can be installed in the slots 46 after the mandrel 40 has been inserted into the housing 48.

The cooperative engagement between the projections 42 and the slots 46 permits some relative displacement between the connectors 36, 38 along a longitudinal axis 54, but prevents any significant relative rotation between the connectors about the longitudinal axis. Thus, torque can be transmitted from one connector to the other, but relative displacement between the connectors 36, 38 is permitted in both opposite longitudinal directions, due to a biasing device 52 being formed in the housing.

In this example, the biasing device 52 comprises a helically formed portion of the housing 48 between the connectors 36, 38. In other examples, separate springs or other types of biasing devices may be used, and it is not necessary for the biasing device 52 to be used at all, in keeping with the scope of this disclosure.

Biasing device 52 operates to maintain the connector 36 in a certain position relative to the other connector 38. In this example, any biasing device (such as a compressed gas chamber and piston, etc.) which can function to substantially maintain the connector 36 at a predetermined position relative to the connector 38, while allowing at least a limited extent of rapid relative longitudinal displacement between the connectors due to a shock event may be used.

Figure 3:
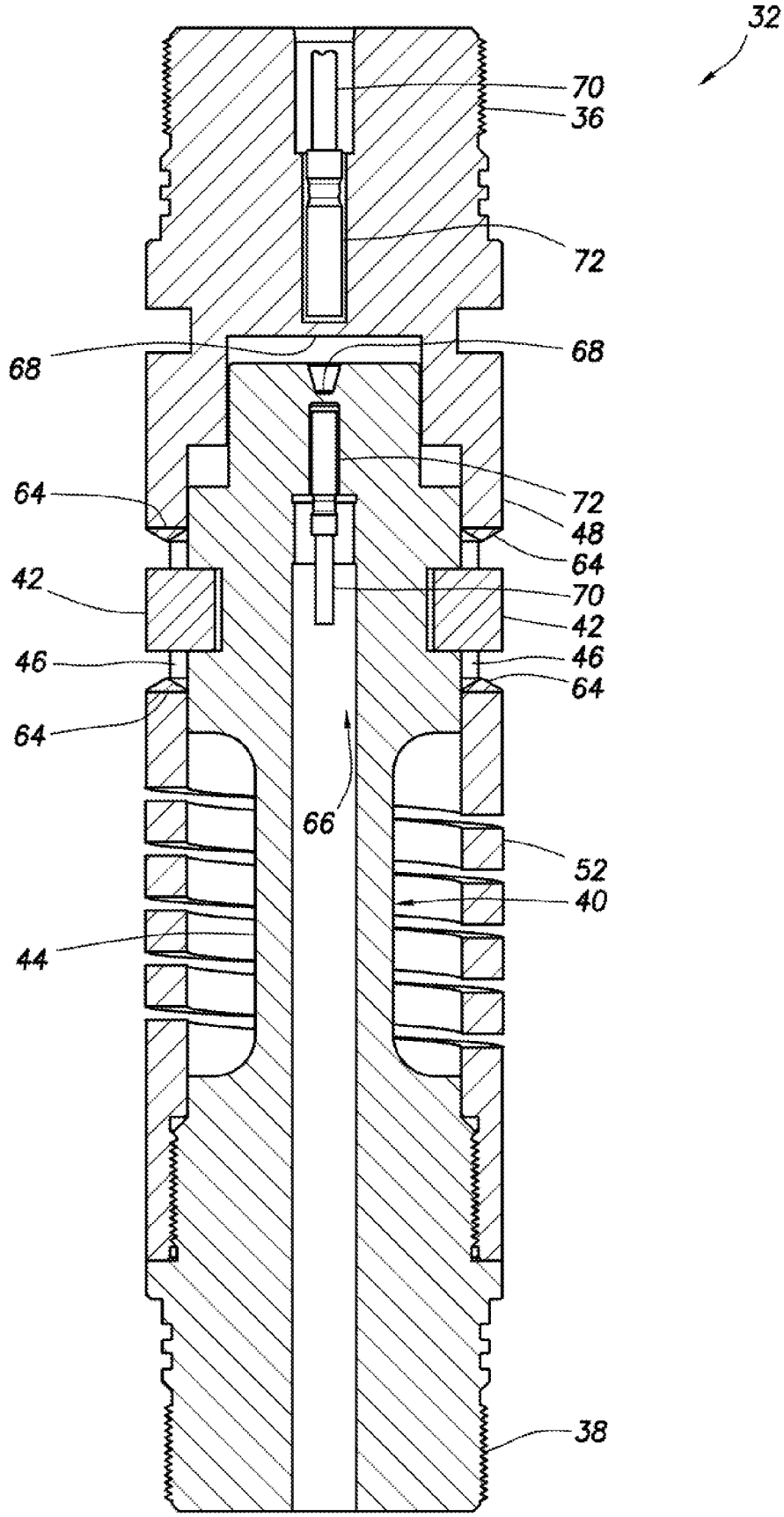
FIG. 3 is a representative cross-sectional view of the bending shock de-coupler, taken along line 3-3 of FIG. 2.

Note that the predetermined position could be "centered" as depicted in FIG. 3 (e.g., with the projections 42 centered in the slots 46), with a substantially equal amount of relative displacement being permitted in both longitudinal directions. Alternatively, in other examples, more or less displacement could be permitted in one of the longitudinal directions.

Energy absorbers 64 are preferably provided at opposite longitudinal ends of the slots 46. The energy absorbers 64 preferably prevent excessive relative displacement between the connectors 36, 38 by substantially decreasing the effective longitudinal compliance of the shock de-coupler 32 when the connector 36 has displaced a certain distance relative to the connector 38.

Examples of suitable energy absorbers include resilient materials, such as elastomers, and non-resilient materials, such as readily deformable metals (e.g., brass rings, crushable tubes, etc.), non-elastomers (e.g., plastics, foamed materials, etc.) and other types of materials. Preferably, the energy absorbers 64 efficiently convert kinetic energy to heat, mechanical strain and/or plastic deformation. However, it should be clearly understood that any type of energy absorber may be used, while remaining within the scope of this disclosure.

If the shock de-coupler 32 of FIGS. 2 & 3 is to be connected between components of the perforating string 12, with explosive detonation (or at least combustion) extending through the shock de-coupler (such as, when the shock de-coupler is connected between certain perforating guns 20, or between a perforating gun and the firing head 30, etc.), it may be desirable to have a detonation train 66 extending through the shock de-coupler.

It may also be desirable to provide one or more pressure barriers 68 between the connectors 36, 38. For example, the pressure barriers 68 may operate to isolate the interiors of perforating guns 20 and/or firing head 30 from well fluids and pressures.

In the example of FIG. 3, the detonation train 66 includes detonating cord 70 and detonation boosters 72. The detonation boosters 72 are preferably capable of transferring detonation through the pressure barriers 68. However, in other examples, the pressure barriers 68 may not be used, and the detonation train 66 could include other types of detonation boosters, or no detonation boosters.

Note that it is not necessary for a detonation train to extend through a shock de-coupler in keeping with the principles of this disclosure. For example, in the well system 10 as depicted in FIG. 1, there may be no need for a detonation train to extend through the shock de-coupler 32 connected above the packer 26.

The mandrel 40 includes a reduced diameter portion 44 which causes the mandrel to have a substantially increased bending compliance. The housing 48 also has a substantially increased bending compliance, due to the biasing device 52 being helically cut through the housing.

Thus, it will be appreciated that the connector 36 can be rotated (angularly deflected) relative to the other connector 38 about an axis perpendicular to the longitudinal axis 54, with relatively high bending compliance. For this reason, bending shock in one component attached to one of the connectors 36, 38 will be mainly reflected in that component, rather than being transmitted through the de-coupler 32 to another component attached to the other connector.

Figure 4:
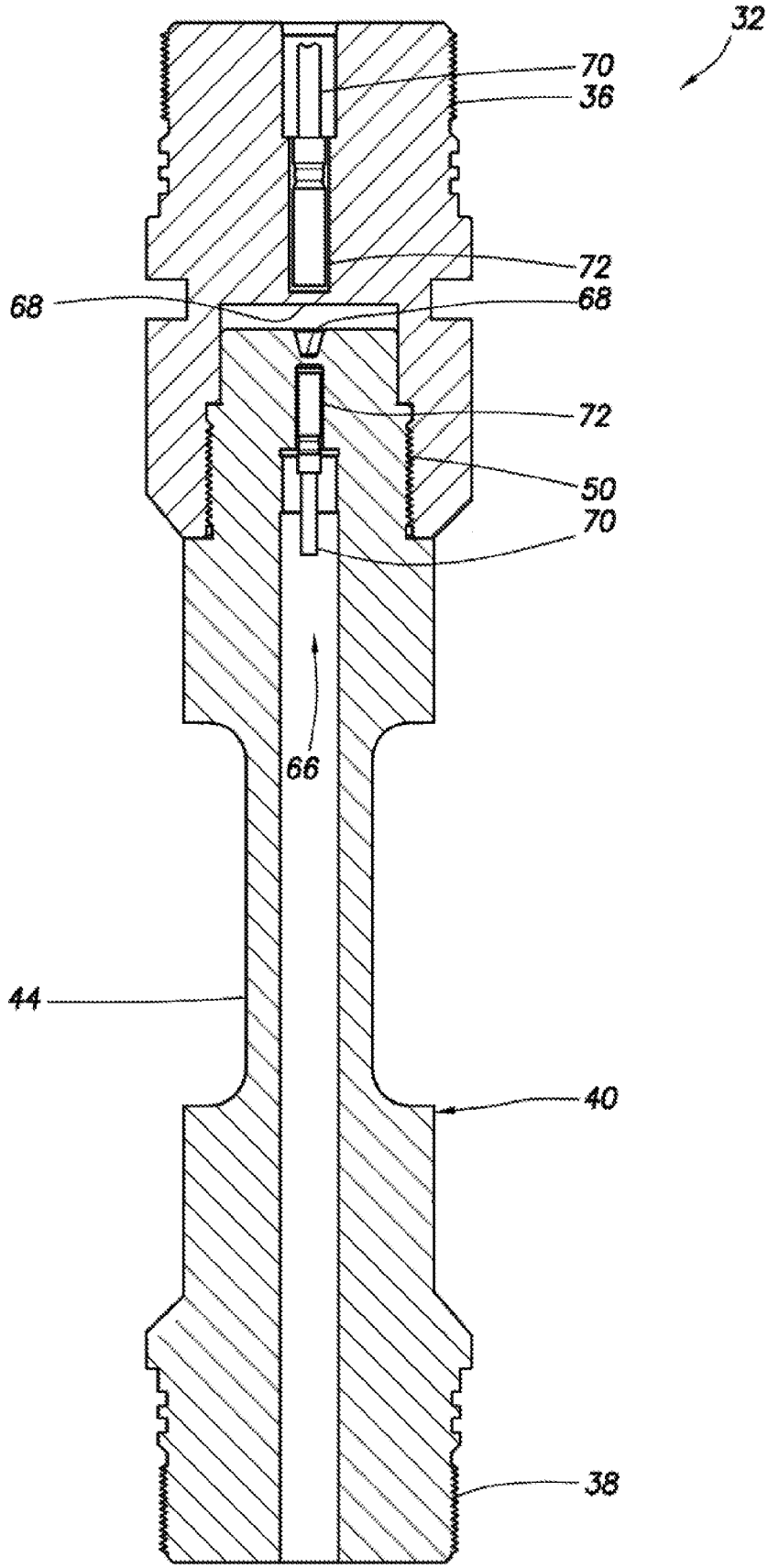
FIG. 4 is a representative cross-sectional view of another configuration of the bending shock de-coupler.

Referring additionally now to FIG. 4, another configuration of the bending shock de-coupler 32 is representatively illustrated. In this configuration, the housing 48 is not used, and the mandrel 40 is secured to the upper connector 36 via threads 50. The reduced diameter 44 of the mandrel 40 provides for increased bending compliance between the connectors 36, 38.

The axial compliance of the FIG. 4 configuration is substantially less than that of the FIGS. 2 & 3 configuration, due to the rigid connection between the mandrel 40 and the connector 36. This demonstrates that various configurations of the shock de-couplers 32 may be designed, with the different configurations having corresponding different bending compliances and axial compliances.

Figure 5:
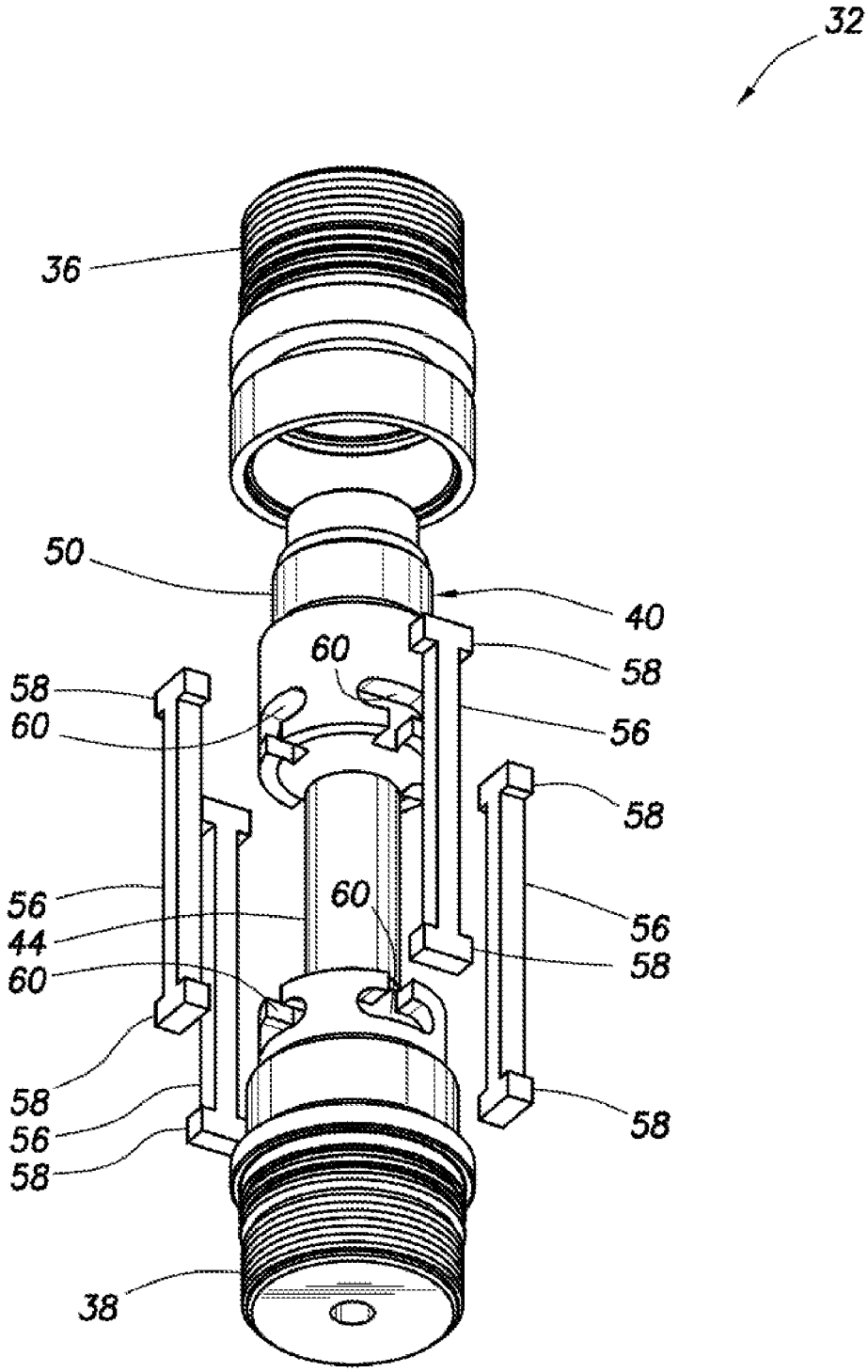
FIG. 5 is a representative exploded view of yet another configuration of the bending shock de-coupler.

In one feature of another shock de-coupler 32 configuration representatively illustrated in FIG. 5, the bending compliance of the de-coupler can be substantially decreased, once a predetermined angular deflection has been reached. For this purpose, the de-coupler 32 of FIG. 5 includes stiffeners 56 circumferentially spaced apart on the mandrel 40.

Each of the stiffeners 56 includes enlarged opposite ends 58, which are received in recesses 60 positioned on opposite longitudinal sides of the reduced diameter portion 44. When the ends 58 are installed in the recesses 60, the stiffeners 56 longitudinally straddle the reduced diameter portion 44.

The recesses 60 are longitudinally wider than the ends 58 of the stiffeners 56, so the ends can displace longitudinally a limited amount relative to the recesses (in either or both longitudinal directions). Therefore, only a limited amount of angular displacement of the connector 36 relative to the connector 38 is permitted, without a stiffener 56 being placed in compression or tension by the angular displacement (due to the ends 58 engaging the recesses 60), thereby decreasing the bending compliance of the de-coupler 32.

The stiffeners 56 may be made of an appropriate material and/or be appropriately configured (e.g., having a certain length, cross-section, etc.) to reduce the bending compliance of the de-coupler 32 as desired. The stiffeners 56 may be constructed so that they decrease the bending compliance of the de-coupler 32, for example, to prevent excessive bending of the perforating string 12. In addition, the stiffeners 56 can impart additional tensile strength to the de-coupler 32 as might be needed, for example, in jarring operations, etc.

Figure 6:
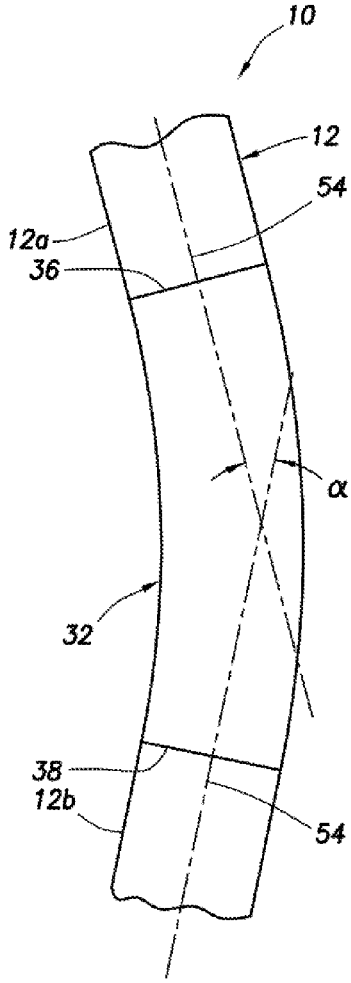
FIG. 6 is a representative side view of the bending shock de-coupler with angular deflection therein.

Referring additionally now to FIG. 6, a representative side view of the de-coupler 32 is representatively illustrated, with the de-coupler interconnected between components 12*a,b* of the perforating string 12. The components 12*a,b* may be any components, arrangement or combination of components (such as, the tubular string 34, the packer 26, the firing head 30, the perforating guns 20, etc.).

When the de-coupler 32 of FIG. 5 is used, the bending compliance of the de-coupler can substantially decrease in response to angular deflection of the connectors 36, 38 relative to one another. For example, the bending compliance may substantially decrease (e.g., due to the ends 58 of the stiffeners 56 engaging the recesses 60) when the connector 36 and attached perforating string component 12*a* have rotated an angle $\alpha$ relative to the connector 38 and attached perforating string component 12*b*, as depicted in FIG. 6.

The de-coupler 32 can be configured, so that it has a desired bending compliance and/or a desired bending compliance curve. For example, the diameter 44 of the mandrel 40 could be increased to decrease bending compliance, and vice versa. As another example, the stiffness of the housing 48 in other configurations could be decreased to increase bending compliance, and vice versa. Cross-sectional areas, wall thicknesses, material properties, etc., of elements such as the mandrel 40 and housing 48 can be varied to produce corresponding variations in bending compliance.

This feature can be used to "tune" the compliance of the overall perforating string 12, so that shock effects on the perforating string are mitigated. Suitable methods of accomplishing this result are described in International Application serial nos. PCT/US10/61104 (filed 17 Dec. 2010), PCT/US11/34690 (filed 30 Apr. 2011), and PCT/US11/46955 (filed 8 Aug. 2011). The entire disclosures of these prior applications are incorporated herein by this reference.

Figure 7:
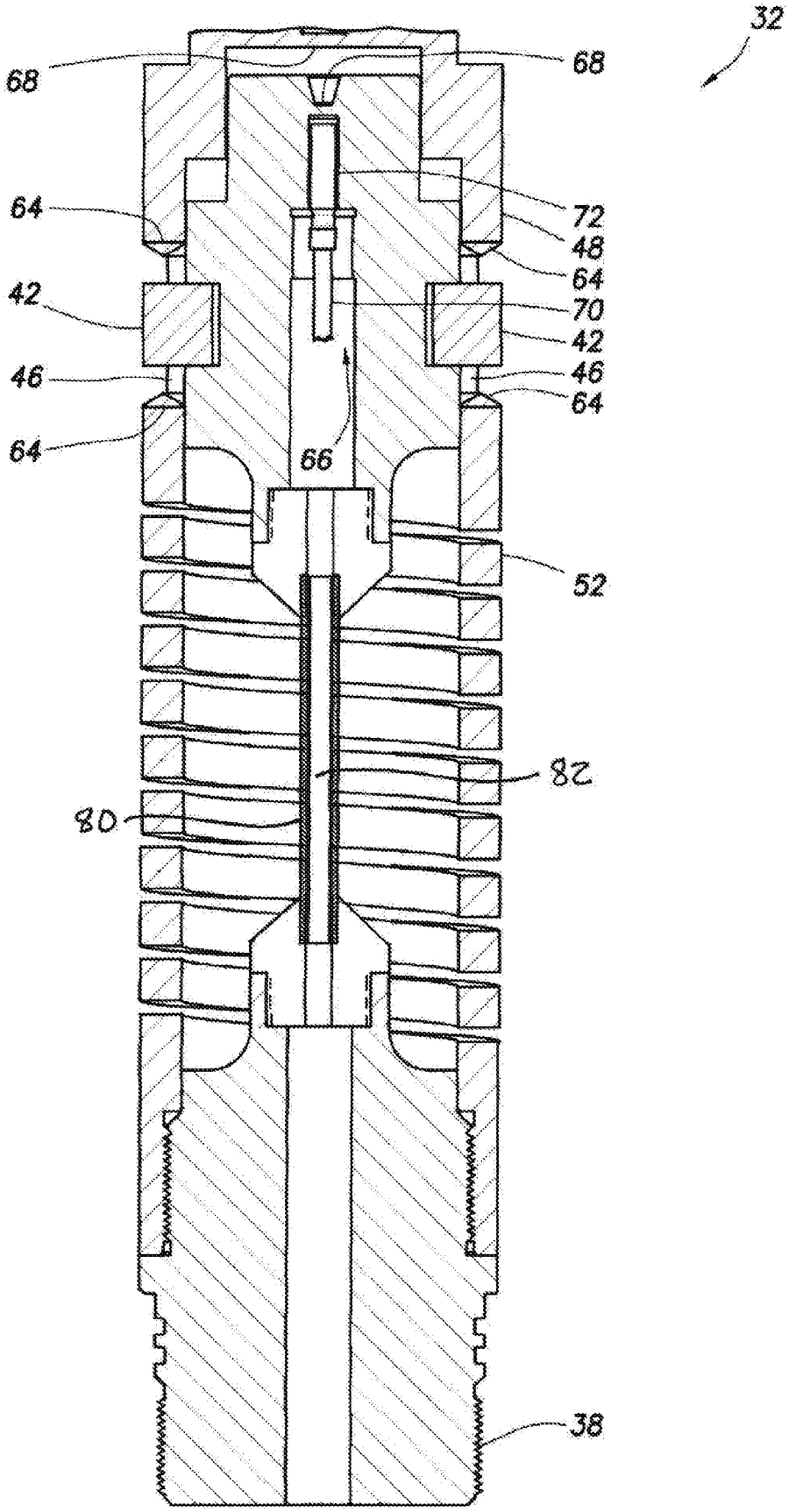
FIG. 7 is a representative cross-sectional view of another configuration of the bending shock de-coupler.

Referring additionally now to FIG. 7, yet another configuration of the de-coupler 32 is representatively illustrated. The FIG. 7 configuration is similar in some respects to the configuration of FIGS. 2 & 3, but differs at least in that the reduced mandrel diameter 44 is not used. Instead, a flexible conduit 80 is used to connect the projections 42 and pressure barrier 68 to the connector 38.

The flexible conduit 80 can be similar to an armored cable (e.g., of the type used for wireline operations, etc.), but having a passage 82 therein for accommodating the detonation train 66 (e.g., so that the detonating cord 70 can extend through the conduit). Preferably, the conduit 80 has sufficient strength to limit axial displacement of the connectors 36, 38 away from each other (e.g., so that such axial displacement is controlled, so that an impact force may be delivered in jarring operations, etc.). To provide additional tensile strength (if needed), and/or to decrease bending compliance upon reaching a certain angular deflection (if desired), the stiffeners 56 and recesses 60 of the FIG. 5 configuration can be used with the FIG. 7 configuration, or the flexible conduit 80 of the FIG. 7 configuration can be used in place of the reduced mandrel diameter 44 in the FIG. 5 configuration.

Note that the conduit 80 and housing 48 in the FIG. 7 example provide for both substantially increased bending compliance and substantially increased axial or longitudinal compliance between the connectors 36, 38. This feature can be used to reflect, instead of couple, axial shock, in addition to reflecting bending shock as described above. The housing 48 in this example can serve to limit relative angular or axial displacement or deflection.

In other examples, the housing 48 may not be used in conjunction with the conduit 80. For example, the conduit 80 could be used in place of the reduced diameter 44 in the configuration of FIG. 4 or 5. Thus, increased bending and/or axial compliance can be provided, whether or not the housing 48 is used.

The examples of the bending shock de-coupler 32 described above demonstrate that a wide variety of different configurations are possible, while remaining within the scope of this disclosure. Accordingly, the principles of this disclosure are not limited in any manner to the details of the bending shock de-coupler 32 examples described above or depicted in the drawings.

It may now be fully appreciated that this disclosure provides several advancements to the art of mitigating shock effects in subterranean wells. Various examples of shock de-couplers 32 described above can effectively prevent or at least reduce coupling of bending shock between components of a perforating string 12, instead reflecting the bending shock. In some examples, an axial compliance of the de-coupler 32 can also be increased, so that coupling of axial shock between components of the perforating string 12 can also be mitigated.

In one aspect, the above disclosure provides to the art a bending shock de-coupler 32 for use with a perforating string 12. In one example, the de-coupler 32 comprises perforating string connectors 36, 38 at opposite ends of the de-coupler 32. A bending compliance of the de-coupler 32 is substantially increased between the connectors 36, 38.

Torque may be transmitted between the connectors 36, 38.

The bending compliance can be increased by reduction of cross-sectional area between the connectors 36 (e.g., by reducing the cross-sectional area of the mandrel 40 and/or housing 48), by reduction of a diameter 44 of a mandrel 40 extending longitudinally between the connectors 36, 38, by reduction of wall thickness (e.g., in the mandrel 40 and/or housing 48), and/or by reduction of material stiffness between the connectors 36, 38.

In one example, the bending compliance substantially decreases in response to angular displacement of one of the connectors 36 a predetermined amount relative to the other connector 38.

Also described above is a well system 10. In one example, the well system 10 can include a perforating string 12 having at least one perforating gun 20 and multiple bending shock de-couplers 32, each of the de-couplers 32 having a bending compliance, and at least two of the bending compliances optionally being different from each other. The different bending compliances may be due to the "tuning" of the perforating string 12 compliance, as described above, although such tuning would not necessarily require that bending compliances of the shock de-couplers 32 be different.

Each of the de-couplers 32 may include perforating string connectors 36, 38 at opposite ends of the de-coupler 32. The corresponding bending compliance of at least one of the de-couplers 32 can substantially decrease in response to angular displacement of one of the connectors 36 a predetermined amount relative to the other connector 38.

A bending compliance of each de-coupler 32 can be substantially increased between the connectors 36, 38. For example, a bending compliance of a middle portion of a de-coupler 32 could be greater than a bending compliance at the connectors 36, 38.

At least one of the de-couplers 32 may be interconnected between perforating guns 20, between a perforating gun 20 and a firing head 30, between a perforating gun 20 and a packer 26, and/or between a firing head 30 and a packer 26. A packer 26 is interconnected between at least one of the de-couplers 32 and a perforating gun 20.

The de-couplers 32 can mitigate transmission of bending shock through the perforating string 12.

In one example described above, a perforating string 12 can include a bending shock de-coupler 32 interconnected longitudinally between two components 12*a,b* of the perforating string 12. A bending compliance of the bending shock de-coupler 32 can substantially decrease in response to angular displacement of one of the components 12*a* a predetermined amount relative to the other component 12*b*.

The bending compliance of the de-coupler 32 may be increased between connectors 36, 38 which connect the de-coupler 32 to the components 12*a,b* of the perforating string 12. In one example, torque can be transmitted between the perforating string components 12*a,b*.

It is to be understood that the various embodiments of this disclosure described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A system for use with a well, the system comprising:

a perforating string including at least one perforating gun which perforates a wall of the well when the perforating gun detonates and multiple bending shock de-couplers, each of the de-couplers having a bending compliance, and at least two of the bending compliances being different from each other.

2. The system of claim 1, wherein each of the de-couplers includes perforating string connectors at opposite ends of the de-coupler.

3. The system of claim 2, wherein the corresponding bending compliance of at least one of the de-couplers substantially decreases in response to angular displacement of one of the connectors a predetermined amount relative to the other connector.

4. The system of claim 2, wherein a bending compliance of each de-coupler substantially increases between the connectors.

5. The system of claim 4, wherein the bending compliance is increased by reduction of cross-sectional area between the connectors.

6. The system of claim 4, wherein the bending compliance is increased by reduction of a diameter of a mandrel extending longitudinally between the connectors.

7. The system of claim 4, wherein the bending compliance is increased by reduction of wall thickness between the connectors.

8. The system of claim 4, wherein the bending compliance is increased by reduction of material stiffness between the connectors.

9. The system of claim 4, wherein torque is transmitted between the connectors.

10. The system of claim 4, wherein an axial compliance of each de-coupler substantially increases between the connectors.

11. The system of claim 1, wherein at least one of the de-couplers is interconnected between perforating guns.

12. The system of claim 1, wherein at least one of the de-couplers is interconnected between a perforating gun and a firing head.

13. The system of claim 1, wherein the de-couplers mitigate transmission of bending shock through the perforating string.

14. A system for use with a well, the system comprising:

a perforating string including at least one perforating gun and multiple bending shock de-couplers, each of the de-couplers having a bending compliance, and at least two of the bending compliances being different from each other, wherein at least one of the de-couplers is interconnected between the at least one perforating gun and a packer.

15. A system for use with a well, the system comprising:

a perforating string including at least one perforating gun and multiple bending shock de-couplers, each of the de-couplers having a bending compliance, and at least two of the bending compliances being different from each other, wherein at least one of the de-couplers is interconnected between a firing head and a packer.

16. A system for use with a well, the system comprising:

a perforating string including at least one perforating gun and multiple bending shock de-couplers, each of the de-couplers having a bending compliance, and at least two of the bending compliances being different from each other, wherein a packer is interconnected between at least one of the de-couplers and the at least one perforating gun.

17. A perforating string, comprising:

multiple bending shock de-couplers interconnected in the perforating string, wherein bending compliances of at least two of the de-couplers are different from each other, and wherein the perforating string includes at least one perforating gun which perforates a wall of the well when the perforating gun detonates.

18. The perforating string of claim 17, wherein the bending compliance of each de-coupler increases between connectors which connect the de-coupler to components of the perforating string.

19. The perforating string of claim 18, wherein the bending compliance is increased by reduction of cross-sectional area between the connectors.

20. The perforating string of claim 18, wherein the bending compliance is increased by reduction of a diameter of a mandrel extending longitudinally between the connectors.

21. The perforating string of claim 18, wherein the bending compliance is increased by reduction of wall thickness between the connectors.

22. The perforating string of claim 18, wherein the bending compliance is increased by reduction of material stiffness between the connectors.

23. The perforating string of claim 18, wherein an axial compliance of the de-coupler increases between the connectors.

24. The perforating string of claim 17, wherein torque is transmitted through the de-couplers.

* * * * *